United States Patent [19]

Schiller

[11] 4,447,689

[45] May 8, 1984

[54] SLIDE ACTUATED, SNAP ACTING MULTIPLE ROCKER SWITCH

[75] Inventor: Werner Schiller, Erzhausen, Fed. Rep. of Germany

[73] Assignee: Max Kammerer GmbH, Oberursel/Taunus, Fed. Rep. of Germany

[21] Appl. No.: 425,398

[22] Filed: Sep. 28, 1982

[30] Foreign Application Priority Data

Nov. 11, 1981 [DE] Fed. Rep. of Germany ..... 3144740

[51] Int. Cl.[3] ..... H01H 3/20

[52] U.S. Cl. ..... 200/330; 200/6 B; 200/67 G; 200/339; 200/68.1

[58] Field of Search ..... 200/67 B, 67 G, 339, 200/331, 330, 6 B, 153 T

[56] References Cited

U.S. PATENT DOCUMENTS

| | | | |
|---|---|---|---|
| 3,588,402 | 6/1971 | Heath | 200/68.1 |
| 3,719,871 | 3/1973 | Houst et al. | 200/153 T X |
| 4,358,646 | 11/1982 | Martinez | 200/18 R X |

FOREIGN PATENT DOCUMENTS

| | | | |
|---|---|---|---|
| 247629 | 11/1963 | Australia | 200/153 T |
| 930780 | 7/1973 | Canada | 200/331 |
| 1615700 | 7/1970 | Fed. Rep. of Germany | 200/6 B |
| 1081383 | 8/1967 | United Kingdom | 200/6 B |

*Primary Examiner*—John W. Shepperd
*Assistant Examiner*—Renee S. Kidorf
*Attorney, Agent, or Firm*—Schwartz, Jeffery, Schwaab, Mack, Blumenthal & Koch

[57] ABSTRACT

A rocker switch comprises a contact spring in the shape of a loop, supported against a pivot member. The spring has a catch in the free end of the loop. The contact spring can be pivoted by means of a rocker lever into its open or closed position. The rocker lever is mounted on a roll provided with two additional cams in the form of a rocker. By means of an elastic switching arm arranged on the slide, the rocker is actuated by overrunning, thereby effecting the pivoting of the end support cam over the pivot member. This in turn yields movement of the contact springs into their open or closed positions. The contact springs may be arranged in series adjacently to each other and/or on a common axis successively to each other with their loop openings in the same or in opposing directions.

15 Claims, 3 Drawing Figures

(A-A)

SLIDE ACTUATED, SNAP ACTING MULTIPLE ROCKER SWITCH

BACKGROUND OF THE INVENTION

1. Field of the Invention

The invention concerns a rocker switch consisting of a contact spring bent in the shape of a loop and supported with a catch against a blade. The contact spring is pivoted by means of a rocker lever into its open and closed positions.

2. Background of the Prior Art

Known switches of this type have been found to be highly suitable in view of their explicit breaking behavior, but they act merely as pure pressure activated switches in the sense that switching from the open position into the closed position and vice versa may be effected individually only by the application of pressure to the rocker lever. Consequently, every switch must be equipped with a separate rocker lever.

SUMMARY OF THE INVENTION

An object of the present invention is to provide a rocker switch actuated by means of slide controls with an explicit breaking behavior. The invention comprises the fact that the spring bent into the shape of a loop is being held between the pivot member or blade and a freely rotating roll member equipped with three cams wherein one of the cams in the role of an end support pivotable over the blade engages a catch arranged in the free branch of the loop spring and the two other cams form a rocker. The rocker is actuated by means of the overrunning of an actuating arm with spring action and mounted on the slide thereby causing the end support cam and thus the contact spring to pivot into its open or closed position, respectively.

The invention provides for the first time a rocker switch actuated by means of a slide control and exhibiting a distinct breaking behavior. This rocker switch utilizes a contact spring in the form of a loop which is held clampingly between the stationary blade and the cam of the cam roll. The explicit breaking behavior is the result of the cooperation of the spring action of the contact spring on the one hand and of the switching arm overrunning the rocker on the other. Aside from the possibility of the continuous setting of the switching slide itself, the throwing of the rocker occurs only when a predetermined position of the switching slide is attained. This is because of the superposed spring actions. The result is that labile intermediate positions of the contact spring are absolutely prevented as are any electrically undetermined switching states.

In a preferred embodiment, the rocker switch of the present invention is designed in the form of an individual switch. However, the invention also renders possible the construction of series switches with an almost arbitrary number of individual switches with a single means of actuation, namely, a single switching slide. In this arrangement, it is sufficient to arrange several contact springs, each with its cam roll actuation in a row adjacently to each other. The switching arm will actuate one cam roll after the other in a direction-dependent rotating motion. The depressed cams facing each other form a catch for the switching arm. In this manner, depending on the number of contact springs arranged adjacent to each other or successively to each other, arbitrary switching programs or interconnections may be provided by means of connections in the form of bus bars and the choice of the installed position of the contact springs. It is further possible, in case of a suitable dimensioning of the switching arm, to arrange a plurality of rockers or cam rolls on one axle and actuate them simultaneously in one rotating direction, while here again, different (electrical) switching states may be established for switches simultaneously operated in this manner by the suitable selection of the installed position of the contact springs.

To facilitate the actuation of the switch, the switching arm is equipped conventionally at its free end with a guide shoe or a rotatable roll.

BRIEF DESCRIPTION OF THE DRAWINGS

The invention is illustrated in the drawing by the example of a blower switch for the air ventillation fan of automotive vehicles. In the drawing.

DETAILED DESCRIPTION OF PREFERRED EMBODIMENTS

Figure 1:
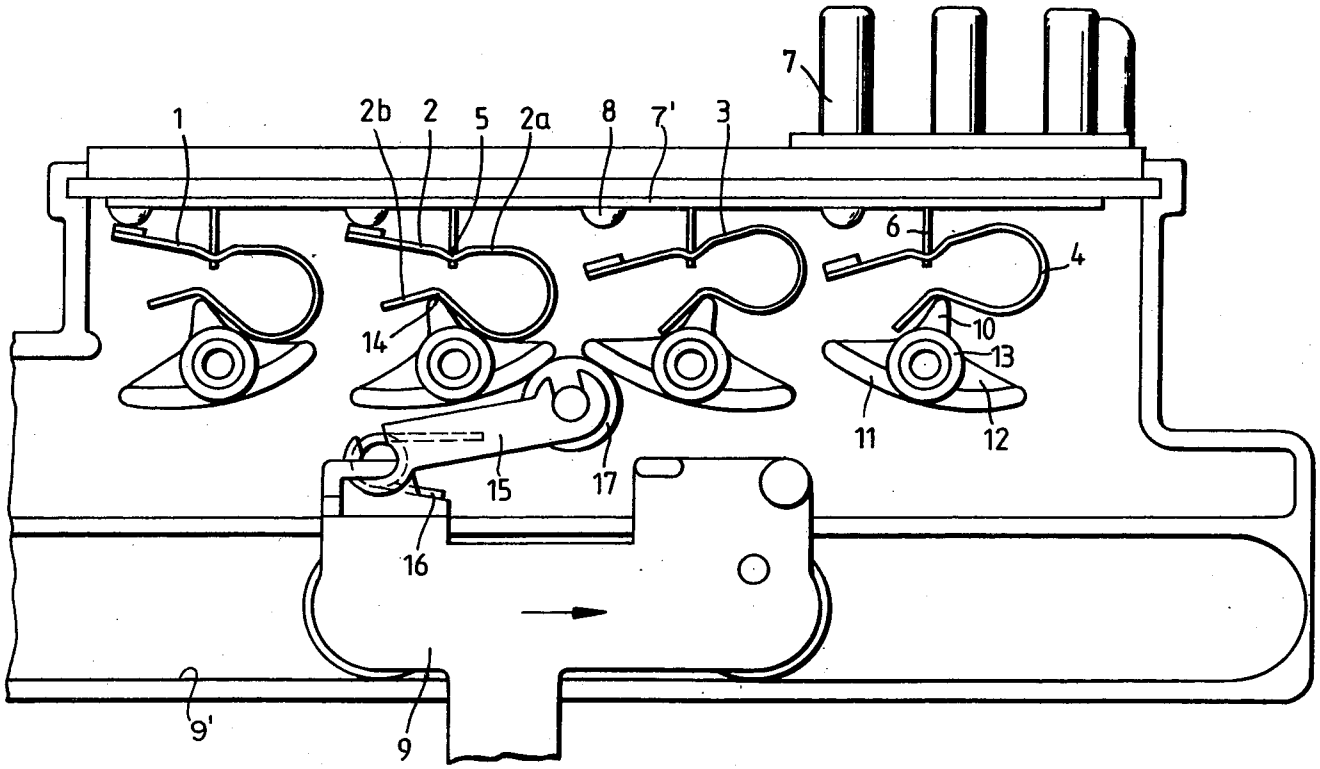
FIG. 1 shows a view of a series switch actuated by means of slide controls.

In the drawings, 1, 2, 3 and 4 designate contact springs, each bent into a loop with two branches. The branches are designated for the sake of clarity only in connection with the contact springs 2, by 2*a* and 2*b*. The springs are equipped in their branches with a catch 5 and supported against a blade 6 which simultaneously is forming through the plug pin 7, and bus 7' of the electrical connection to the springs 1 to 4. One of the counter contact rivets is designated by 8. Actuation is by the switching slide 9 mounted in track or guide means 9'. Thus, the electrical path can be from plug pin 7, through bus 7', blades 6 and springs 1 to 4 to contact rivets 8.

The springs 1, 2, 3 and 4 bent in the shape of loops are held between the blade 6 and a roll 13. Three cams 10, 11 and 12 are provided and supported on an axle in a freely rotating manner wherein the cam 10 engages in the role of an end support pivoting over the blade 6, a catch 14 provided in the branch 1*b*, 2*b*, 3*b*, 4*b* and the two cams 11, 12 form a rocker. The rocker is actuated by means of a switching arm 15 articulated on the slide 9 and held in a springingly elastic manner by means of a tension spring 16 against the cam roll 13. At the free end of the switching arm 15, a roller 17 is arranged to facilitate travel over the rolls. A guide shoe may be provided in place of the roller 17.

The individual rocker switches exhibit a distinct breaking behavior as the result of the spring actions of the contact springs 1, 2, 3 and 4 on the one hand and of the switching arm 15 running over the rockers 11, 12 on the other. Unstable intermediate positions of the contact springs 1, 2, 3 and 4 are absolutely prevented.

In FIG. 1 of the drawing, the invention is represented by the example of a four-stage series switch. The four switches displaying their contact springs in the same direction are arranged adjacent to each other so that the switching arm 15 and the roller 17 respectively are actuating successively one cam after the other. In the position shown, the roller 17 has just depressed the cam 12 to close the contact spring 2, while the contact spring 1 is already in its closed position and the contact spring 3 is in the open position. The rockers, tilted against each other, are forming a catch for the roller 17 and the switching arm 15.

In the course of the further movement of the slide 9 in the direction indicated by the arrow, the roller 17 runs over the cam roll actuating the contact spring 3. The cam roll yields in an elastic manner and acts on the cam 12 on the roll, whereby the rocker is abruptly reversed and thus following the passage of the cam 10 over the blade 6. The contact spring is also moved into its closed position. There is no change in the switching states of the contact springs 2 and 4.

In a similar manner, the contact 4 may be closed by the continued movement of the slide 9 in the direction of the arrow, while the contacts are opened by the displacement of the slide 9 in the direction opposite to that of the arrow in a reversed sequence.

By providing interconnections between the current paths connected, overrides may be established wherein merely by reversing the arrangement of one or more contact springs so that the opening of the loop of the contact spring is in the opposite direction, circuits opposing each other may be obtained. Thus, for example, the contact spring 3 in a reversed position may be opened by the displacement of the slide 9 in the direction of the arrow while contact springs 1, 2 and 4 are closed during movement in that direction.

Figure 2:
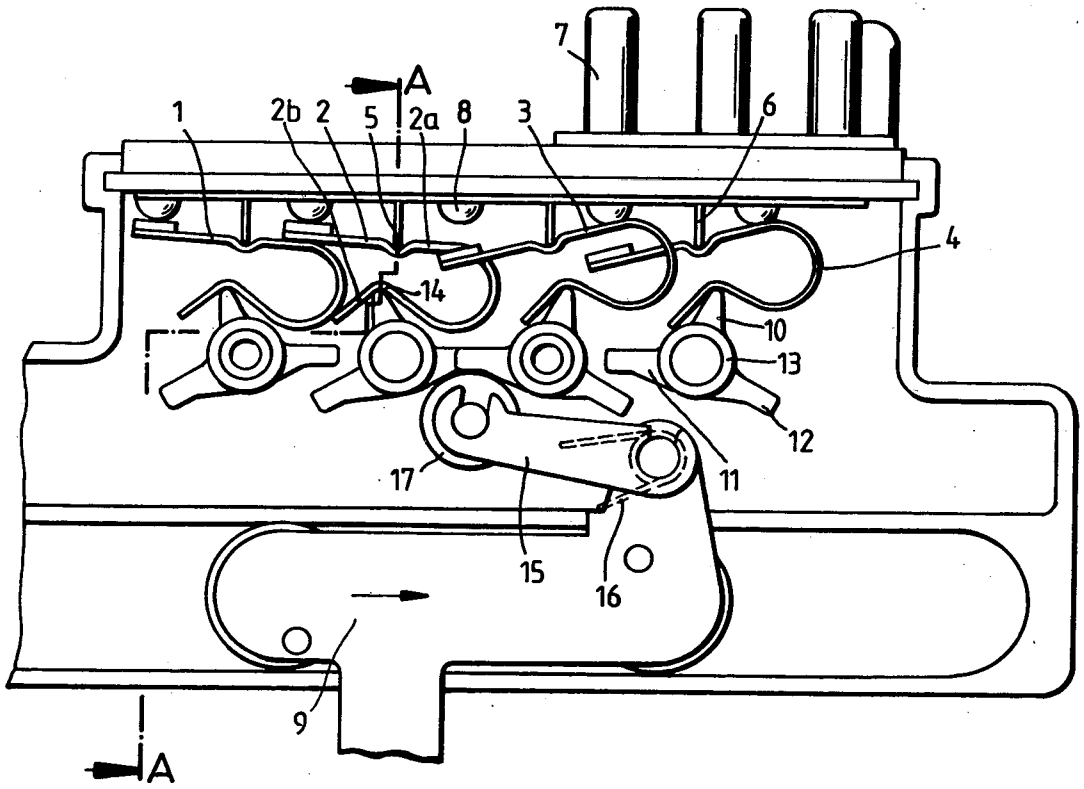
FIG. 2 illustrates a view of a series switch actuated by means of slide controls with switching rolls arranged in two states in an offset manner.
Figure 3:
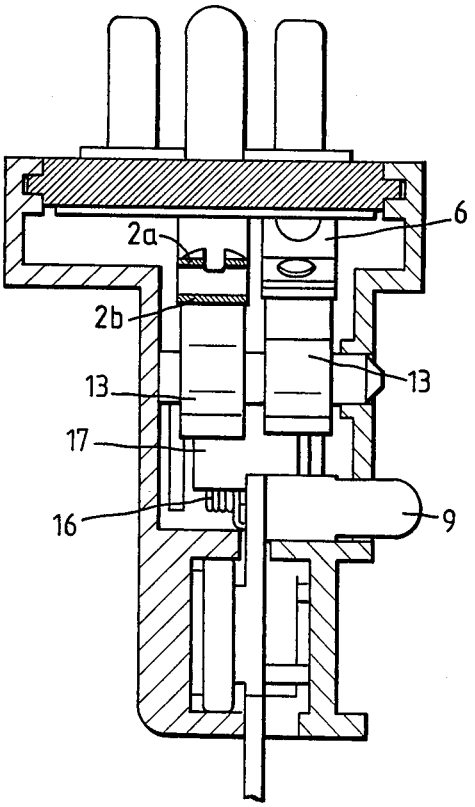
FIG. 3 shows a cross section through FIG. 2 on A—A.

With appropriate dimensioning, two or more switches may be arranged in the same switching plane. This is accomplished by placing the cam rolls on a common axle so that it is possible overall to combine an arbitrary number of row or series switches in a program circuit to be actuated by a single control slide. It is further possible, as in the embodiments of FIGS. 2 and 3, to arrange the springs 1 to 4 on a common frame and correspondingly, the cam rolls 13 in two successive planes or stages and offset with respect to each other, so that the pivoting ranges of the cams of adjacent cam rolls are partially overlapping. In this manner, a highly compact configuration of the current switch is obtained with an otherwise identical layout and mode of operation.

The above description describes a preferred embodiment of the invention. It is to be understood however, that the invention is not limited to any single embodiment or feature, but should be construed to cover all modifications and alternative embodiments falling within the scope of the invention as defined by the claims which follow.

What is claimed is:

1. A slide actuated, snap acting multiple rocker switch comprising:

a plurality of contact springs each being in the shape of a loop and each being mounted on a pivot member and having a contact point at one end and a catch adjacent the opposite end, a corresponding roll member for each of said contact springs, each of said roll members being mounted for rotation about an axis, and each of said roll members having two cams forming a rocker and a third cam engaging said catch, guide means, switching slide means mounted on said guide means for movement along said guide means, said switching slide means including a portion adapted to contact successive ones of said rockers as said switching slide means is moved along said guide means for successive actuation of said contact springs, and said rockers being so spaced that adjacent ones of said rockers form a detent for said switching slide means between adjacent ones of said rockers.

2. The rocker switch of claim 1, wherein each of said roll members is centrally mounted over a pivot member.

3. The rocker switch of claim 2, wherein each of said contact springs is mounted on the pivot member at one side of the loop shape and said catch is located in the side of the loop shape opposite said mounted side.

4. The rocker switch of claim 3, wherein said switching slide means comprises a switching arm and means biasing said switching arm against said rockers.

5. The rocker switch of claim 4, wherein said guide means comprises a track.

6. The rocker switch of claim 5, wherein said biasing means comprises a tension spring.

7. The rocker switch of claim 6, wherein said switching arm extends from said slide toward said rockers and includes a rocker contact member mounted on the free end of said actuator arm member.

8. The rocker switch of claim 7, wherein said rocker contact member is a rotating roller.

9. The rocker switch of claim 8, wherein said contact springs are mounted adjacent one another with their loops facing the same direction.

10. The rocker switch of claim 8, wherein said contact springs are mounted adjacent one another with the adjacent loops facing opposite directions.

11. The rocker switch of claim 8, wherein said contact springs are mounted in stages, each stage offset from the remaining stages.

12. A method of actuating an electrical switch in a series of electrical switches comprising:

moving a switching arm along a series of rockers each having a plurality of cams forming the rockers and wherein one cam of each of said rockers actuates one of said series of switches and wherein another of said cams of each rocker forms a catch with another cam of an adjacent rocker and;

engaging said switching arm in said catch after one of said switches has been actuated and before the next switch in said series is actuated.

13. The method of claim 12, wherein said moving step causes pivoting of at least one of said rockers and causes pivoting of a looped contact spring into open or closed positions.

14. The method of claim 13 wherein a plurality of contact springs mounted on a common frame are actuated successively by movement of said switching arm in one direction.

15. The method of claim 14, wherein the plurality of contact springs are in simultaneous engagement.

* * * * *